United States Patent [19]

Grote et al.

[11] Patent Number: 4,819,719

[45] Date of Patent: Apr. 11, 1989

[54] ENHANCED EVAPORATOR SURFACE

[75] Inventors: Michael G. Grote, St. Louis; John A. Stark, Florissant; Edward C. Tefft, III, St. Louis, all of Mo.

[73] Assignee: McDonnell Douglas Corporation

[21] Appl. No.: 4,625

[22] Filed: Jan. 20, 1987

[51] Int. Cl.[4] ..... F28D 15/02

[52] U.S. Cl. ..... 165/104.26; 165/133; 122/366

[58] Field of Search ..... 165/133, 104.26; 122/366

[56] References Cited

U.S. PATENT DOCUMENTS 4,015,659 4/1977 Schladitz ..... 165/104.26

4,359,086 11/1982 Sanborn et al. ..... 165/133

FOREIGN PATENT DOCUMENTS 1136003 1/1985 U.S.S.R. ..... 165/104.26

*Primary Examiner*—Albert W. Davis, Jr.
*Attorney, Agent, or Firm*—George W. Finch

[57] ABSTRACT

An enhanced capillary assisted evaporative surface for use in heat transfer devices; such as, 2-phase mounting plates, heat pipes and collectors. Rectangular grooves are cut in a conductive substrate and then plated by vapor deposition. The process produces a necked-down opening in the groove and a dendritic surface improving both capillary pumping and heat transfer coefficients.

11 Claims, 5 Drawing Sheets

ENHANCED EVAPORATOR SURFACE

BACKGROUND OF THE INVENTION

This invention relates generally to vaporization heat transfer devices and, more specifically, to the structure and method of constructing multiple groove wicks which comprise the capillary assisted evaporator surface in these devices. The enhanced surface of this invention can be used in any device which uses capillary forces to spread liquid over an evaporating surface, e.g., 2-phase mounting plates, heat pipes, solar collectors and, generally, heat sink devices.

The use of microgrooves as the wick, or capillary structure, for capillary assisted evaporator surfaces is well known in the art. Performance of these devices can be considered in two parts. The first part is the distribution of the liquid onto the grooved, evaporative surface. The second is the mechanism of transferring heat to the liquid film, which causes the liquid to evaporate. The liquid distribution is governed by the capillary pumping ability of the grooves in the evaporative surface and by the means for getting the liquid to the grooves which may be another interfacing wick. The mechanics of calculating the performance of the capillary pumping ability of the grooves or wick is well covered in the literature, see, e.g., Frank, S., "Optimization of Grooved Heat Pipe," Intersociety Energy Conversion Conference, 1967 or U.S. Pat. No. 3,598,180 to R. E. Moore, Jr. Evaporation is represented by a heat transfer coefficient, whose magnitude is determined by the groove geometry and the liquid film distribution. Groove geometry is also discussed in the literature. See e.g., Harwell, W., Kaufman, W. B., Tower, L., "Re-Entrant Groove Heat Pipe," American Institute of Aeronautics and Astronautics 12th Thermo Physics Conference, June 1977 and U.S. Pat. No. 4,274,479 to Eastman. The latter reference teaches several different cross sectional configurations for grooves and further teaches narrowing or blocking of the grooves to assure that the capillary pumping pressure is maximum at the vapor liquid interface which should occur at the narrowest portion of the groove. However, the problem with the prior art is not a failure to properly describe the generally preferred groove geometry, but it was extremely difficult and expensive to achieve. To achieve the proper groove geometry, the grooves were either extruded or, as taught in Eastman, the grooves were formed on the inside of a heat pipe from metal powder sintered in place around shaped mandrels to form the wick. In both of these methods, the lands or material between the grooves was far too thick for efficient operation. For rectangular grooves most of the heat transfer occurs in a small area where the liquid meniscus attaches to the groove top. There is very little heat transfer from the land area between the grooves. With groove spacing equal to the groove width, mathematical analysis shows that the heat transfer coefficient increases as the groove width and spacing decrease. A rigorous analysis of capillary performance and evaporative heat transfer suggests that the evaporative surface is improved by: (1) decreasing groove width to get higher capillary pressures; (2) increasing the number of grooves per centimeter to allow higher heat transfer coefficients (same heat per groove, with more grooves); (3) increasing the groove cross-sectional area and hydraulic diameter to provide lower flow pressure loss; and (4) making more effective use of the land area for heat transfer.

It is an object of this invention to provide an enhanced capillary assisted evaporator surface by providing a small capillary radius at the groove opening to optimize the capillary pumping, while maintaining a large flow area and, at the same time, significantly increase the heat transfer coefficient by making more effective use of the land area between grooves.

SUMMARY OF THE INVENTION

The above objects are accomplished by machining many fine, deep, rectangular grooves, in the range of 40 grooves per centimeter, into a conductive plate and then vapor depositing very fine particles of metal, preferably aluminum, on the conductive plate so as to modify the shape of the groove surface and the groove geometry by vapor deposition. The vacuum plating further creates closely packed, dendritic extensions from the land area between the grooves greatly enhancing the meniscus attachment surface area which is the primary region for evaporative heat transfers. Also, since vacuum plating is essentially a "line-of-sight" process, most of the aluminum is deposited on the land area between the grooves, while very little aluminum is deposited inside the grooves, narrowing the groove opening while essentially maintaining the balance of the cross sectional flow area of the groove. Thus, the enhanced evaporative surface of this invention provides both improved capillary pumping and a higher heat transfer coefficient.

DETAILED DESCRIPTION OF THE PREFERRED EMBODIMENT

Figure 1:
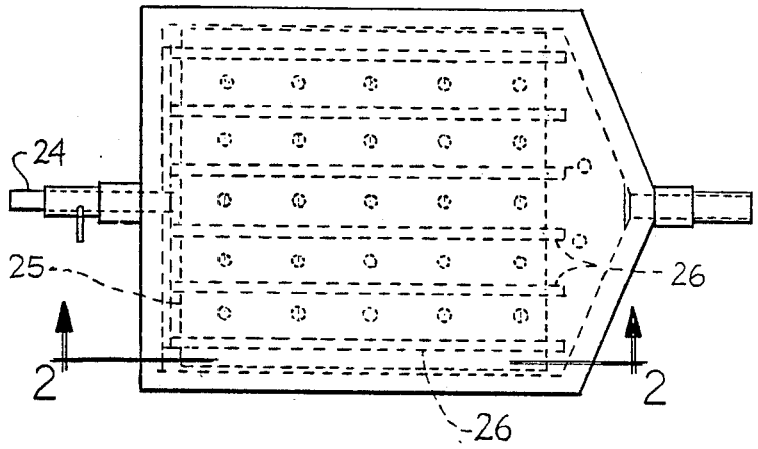
FIG. 1 is a plan view of a full scale two-phase mounting plate and represents the mounting plate used to test the enhanced evaporative surface of this invention.
Figure 2:
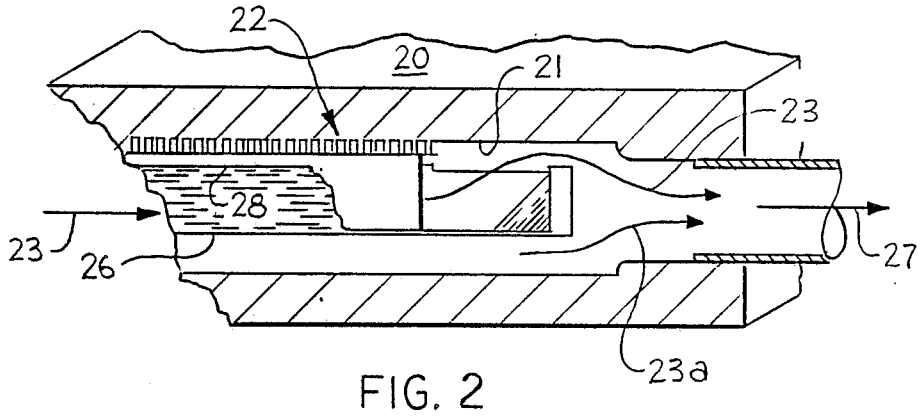
FIG. 2 is an enlarged partial section of FIG. 1 showing the basic concept of the two-phase mounting plate.

FIGS. 1 and 2 show an element of a thermal control system which is capable of transporting large amounts of heat over long distances. The element is known as a two-phase mechanically pumped mounting plate upon which a heat producer such as electronic equipment is mounted. The mounting plate provides the cooling means. The mounting plate is a variation of the heat pipe in which the working fluid is both mechanically pumped and capillary pumped and sees both liquid and vapor phases to take advantage of the heat of vaporization. Its advantage over an all liquid cooling system is its reduced mass and pumping power as is characteristic of a heat pipe. It is shown here to demonstrate how the enhanced evaporative surface of this invention is employed.

The two phase mounting plate (TPMP) has an upper surface 20 where various heat generating equipment may be mounted. The upper plate's inner surface 21 contains many fine and closely spaced grooves shown at 22. Liquid working fluid is pumped through the inlet 24 and distributed via header 25 to the feed tubes 26. Each feed tube 26 has a longitudinal slot 28 which holds an interface wick 29. Wedge clamps (not shown) below the feed tubes 26 hold the wick firmly against the grooves 22. Capillary action of the grooves 22 draws the working fluid from the feed tube 26 through the interface wick 29 and into the grooves 22, where it is evaporated by the heat produced by the mounted equipment. Only the liquid required for evaporation is drawn onto the grooved surface. Excess liquid 2 flows out the end of the feed tube. At this point the excess working fluid mixes with vapor 23*a* generated at the groove surface and exits the TPMP as a two-phase mixture 27. The low-conductivity interface wick 29 thermally isolates the feed tube from the grooved inner surface 21, preventing boiling inside the feed tubes 26.

Performance of the TPMP can be considered in two parts. The first is a distribution of the liquid onto the grooved inner surface 21 which is the evaporative surface. The second part is the mechanism of transferring heat to the liquid film, which causes the liquid to evaporate. The first part, liquid distribution, is governed by the capillary pumping ability of the grooves in the evaporative surface and of the feed tube interface wick. The second part, evaporation, is represented by a heat transfer coefficient, whose magnitude is determined by the groove geometry and the liquid film distribution.

Figure 5:
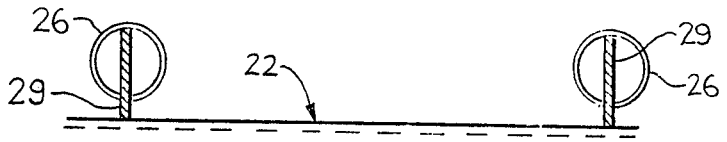
FIG. 5 is a diagrammatic sketch of two feed tubes in relationship to the grooved evaporative surface.
Figure 6:
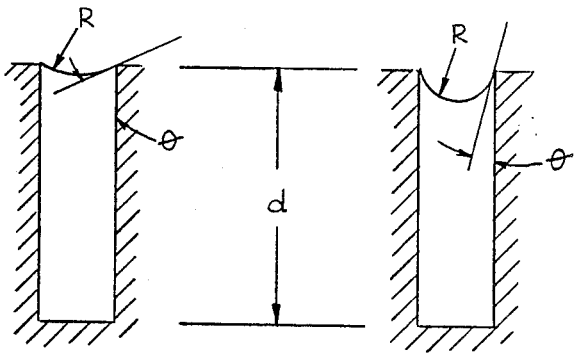
FIG. 6 shows the meniscus geometry in the grooves at two cuts, AA and BB of FIG. 5.

The capillary pumping capacity in a groove or wick structure is determined by a balance of capillary pumping pressure and flow pressure loss in the groove. Liquid flowing in a rectangular groove will experience a local capillary pressure of $$P_C(x) = \frac{\sigma}{R(x)} = P_v - P_l(x)$$

where x is the distance from the interface wick along the groove, and R(x) is the meniscus radius at the distance x. Since the liquid pressure in the groove, $P_1$, decreases with x due to flow losses, the meniscus radius, R, must also decrease to maintain the pressure balance (i.e., the meniscus becomes more concave as the distance from the interface wick increases). FIGS. 5 and 6 depict the pressure balances acting along the groove flow path. The liquid flow pressure loss in the groove is described by several well known formulas, however, they combine to form a complex integral.

Figure 7:
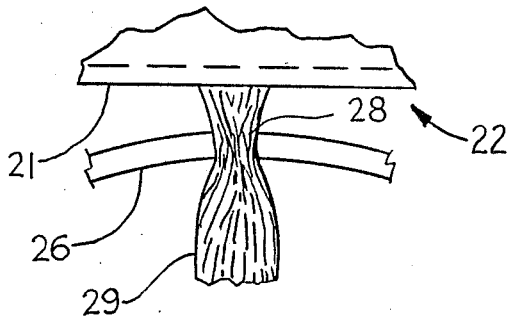
FIG. 7 is an enlarged view of the interface wick and feed tube in relationship to the grooves.

The wicking performance of the interface wick 29 must also be calculated in a similar fashion. The interface wick must be matched to the grooved surface in order to attain optimum performance. Because of the way the interface wick 29 is held in the feed tube 26 the interface wick flow resistance can be increased independently of the wick's capillary pumping pressure, which depends on the wick pore size. The wick flow resistance is controlled by the amount of crimping of the feed tube slot 28 in which the interface wick 29 is held (see FIG. 7).

The TPMP performance is said to be interface wick limited if the interface wick pore size is larger than the groove width, or if the maximum capillary stress in the wick is less than the combination of flow resistance and gravity head experienced in the wick. Therefore, an interface wick must be chosen with a sufficiently small pore size to provide good capillary pumping while having a low flow resistance. If the interface flow resistance $R_w$ is too large, the grooved surface will tend to dry out before the groove wicking limit is reached. On the other hand, if $R_w$ is too small, excess liquid may be pushed on to the grooved surface, causing flooding. Flooding results in a thickened liquid layer, which decreases the heat transfer coefficient, and could possibly allow boiling to occur.

Figure 15:
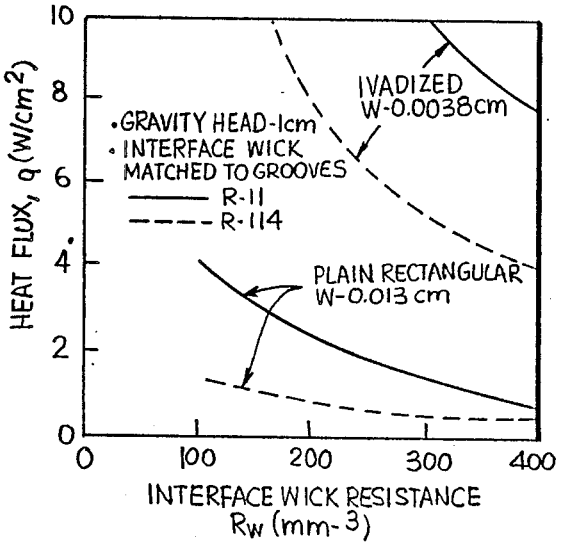
FIG. 15 is a plot of theoretical capillary performance of two alternative groove widths, plain and with vapor deposited aluminum, of the two-phase mounting plate.

FIG. 15 shows how maximum heat flux depends on interface wick resistance and groove width. The curves show that with narrower grooves, higher values of interface wick resistance can be used before the wick limit is reached. Further, the narrower grooves allow higher interface wick resistance which in turn allows operation at lower fluxes without flooding.

The first part, capillary performance, of the two-part evaluation clearly indicates that the ideal groove would have a narrow opening while providing a large flow area and hydraulic diameter for low pressure losses.

Figure 9:
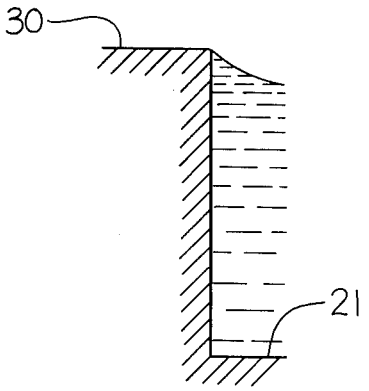
FIG. 9 shows the meniscus attachment in a plane rectangular groove.

The second part of the TPMP's performance is the process of evaporation from the grooved surface. Evaporation occurs almost exclusively in the immediate region of the groove tips where the meniscus is attached. See FIG. 9. Since the liquid thermal conductivity is so much less than that of the metal groove material, the latter is the path of least thermal resistance. As long as the conduction distance from the groove tip to the liquid surface is sufficiently small, heat can be transported to the surface without superheating the liquid next to the groove so as to generate vapor bubbles. The evaporative heat transfer formulas clearly show that the heat transfer coefficient increases as the groove width and spacing decrease.

The above analysis of capillary performance and evaporative heat transfer suggests that the evaporative surface might be improved by: (1) decreasing groove width to improve capillary pressures, (2) increase the number of grooves per centimeter to allow higher heat transfer coefficients (same heat per groove, with more grooves), (3) increasing the groove cross-sectional area and hydraulic diameter to provide lower flow pressure losses, and (4) make more efficient use of the land area between the grooves for heat transfer. Where rectangular grooves are used, improvements 1 and 2 are best implemented, by reducing the groove width and the spacing between grooves. Improvement 3 is best implemented by increasing the depth of the groove if the width is not decreased drastically. Applying the best known machining skills, a groove approximately 0.013 cm by 0.064 cm is the narrowest and deepest groove that can be made in aluminum, for instance, at a reasonable cost. This groove size does not have sufficient heat flux capacity (capillary pumping) for many applications, especially where Freon is used as the working fluid. Improvement 4 is best implemented by covering the land area with many protrusions for meniscus attachment.

Figure 3:
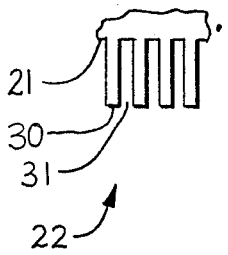
FIG. 3 is an enlarged view of the plate grooves.
Figure 4:
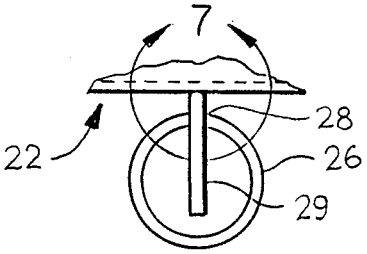
FIG. 4 is an enlarged view of the interface wick, liquid feed tube and its interface with the evaporative surface grooves.
Figure 8:
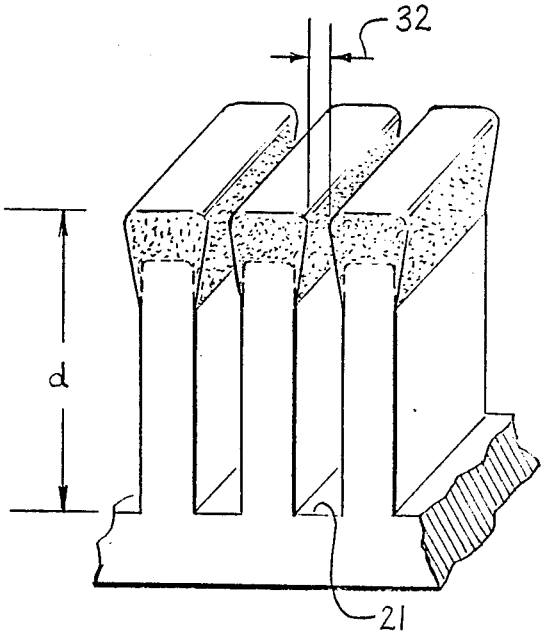
FIG. 8 is a sketch of the groove shape after vacuum plating.

An evaporative surface was prepared by machining rectangular grooves 0.013 cm (0.005 in.) wide by 0.064 cm (0.025 in.) deep with 40 grooves per centimeter (100 grooves per inch) and the groove land 30 having a width equal to the groove opening in a conductive surface as shown in FIG. 3. The material used was aluminum but any conductive material could be used. Aluminum was then vacuum vapor deposited on to the grooved substrate surface to enhance the evaporative surface as shown in FIG. 8. The actual vacuum plating system used to produce the shapes and test results discussed herein was a process known as Ivadizing TM covered by U.S. Pat. No. 4,233,937 to K. E. Steube and is an ion vapor deposition process. Both the trademark and the patent are owned by the McDonnell Douglas Corporation, St. Louis, Mo. However, any vacuum plating system, including but not limited to sputtering, ion vapor deposition, or physical vapor deposition, would produce similar groove and surface modifications. However, the noted process produces a superior bond between the plated and parent metals. Since vacuum plating systems only affect structure in its "line of sight", most of the plated metal is deposited on the land area 30 between groove openings 31 while very little plated metal is deposited inside the grooves. The result is that the groove opening 31 is made narrower or necked at 32, with a generally radiused contour, while the cross-sectional area (original groove opening 31× the depth of the groove "d") of the groove remains essentially unchanged. The narrowing or necking of the groove opening increases the capillary pumping capacity of the groove, as previously discussed. The vacuum plating process permits controlling the groove opening size to widths less than 0.004 cm. The best technique is to place the grooved surface immediately below the ion vapor source.

Figure 10:
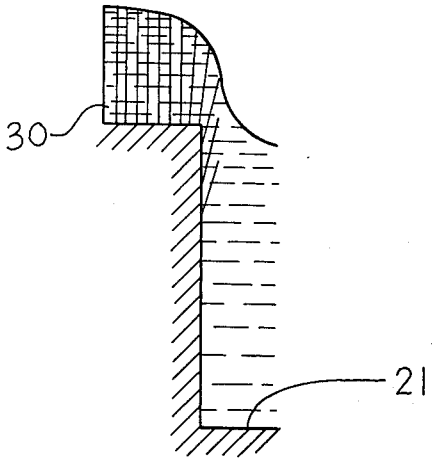
FIG. 10 shows the meniscus attachment of the vacuum plated groove.

The nature of the vacuum plating process is such that the coated surface is not smooth but consists of many columnar dendrites so as to produce what one might consider a porous surface although the pores do not penetrate to the parent metal. The liquid meniscus attaches to the end of each individual dendrite, making each an ideal location for fast evaporation, since the liquid film is very thin on this surface. Due to the abundance of these dendrites, the meniscus attachment surface is much larger than it is in a plain regular machined groove which greatly enhances the heat transfer. The changes in the meniscus shape are compared in FIGS. 9 and 10, before and after vacuum plating.

Figure 11:
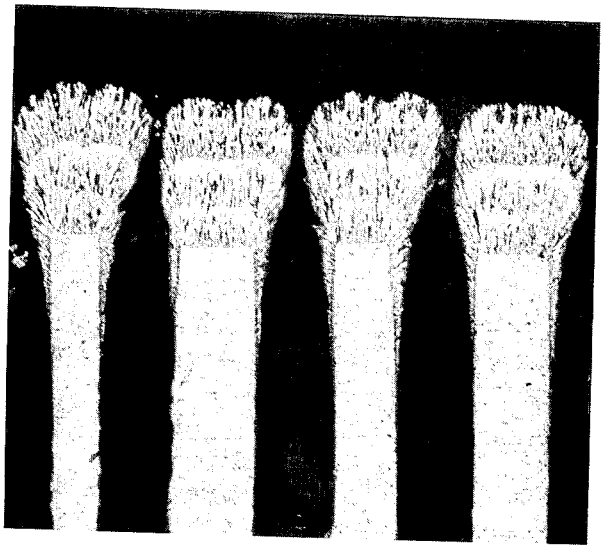
FIGS. 11 and 12 are halftones made from photographs of the grooves after vapor deposition of the aluminum.
Figure 12:
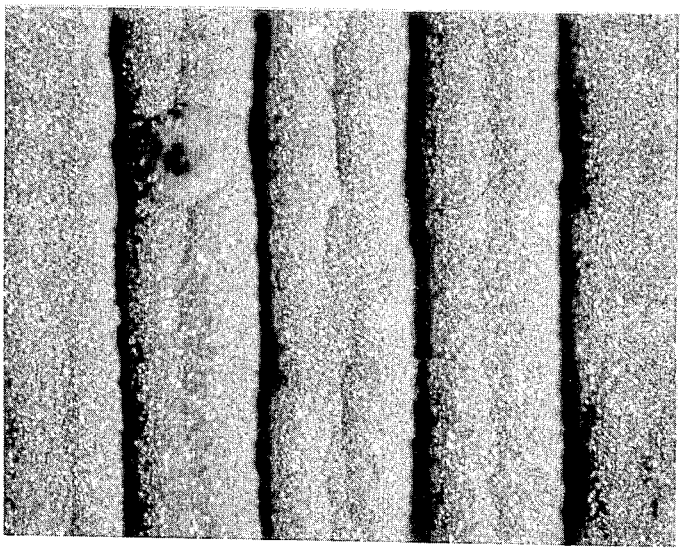

Thus vacuum plating enhances the evaporative surface by improving the capillary pumping capacity by narrowing the groove opening, which increases the meniscus maximum stress dramatically while the cross-sectional flow area in the groove is not reduced. Also, the porous or dendritic surface provides additional capillary action increasing liquid communication with the evaporation sites. The dendritic or porous surface is shown in the halftones made from photo micrographs of the grooves after vacuum plating in FIGS. 11 and 12. Despite the somewhat fragile appearance of the dendritic structure, the vacuum plated surface is fairly hard and is difficult to scratch or chip.

Figure 13:
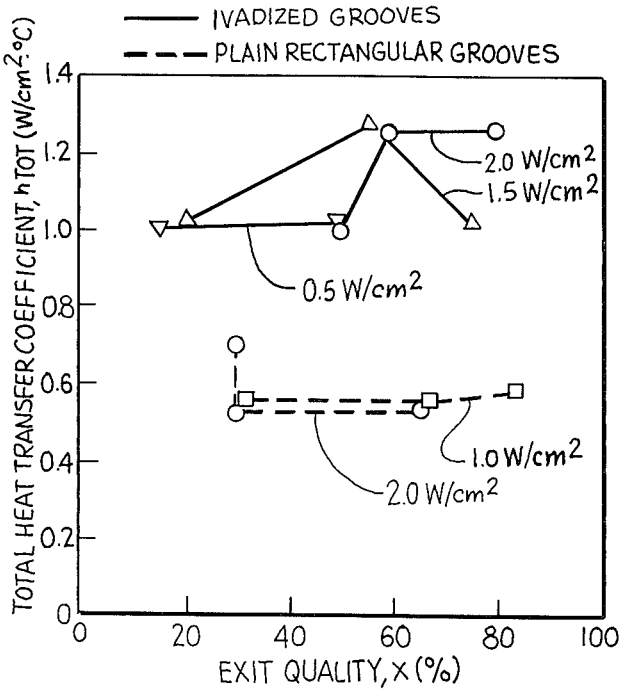
FIG. 13 is a plot of total heat transfer data for the plain rectangular grooves and the grooves after vapor deposition.
Figure 14:
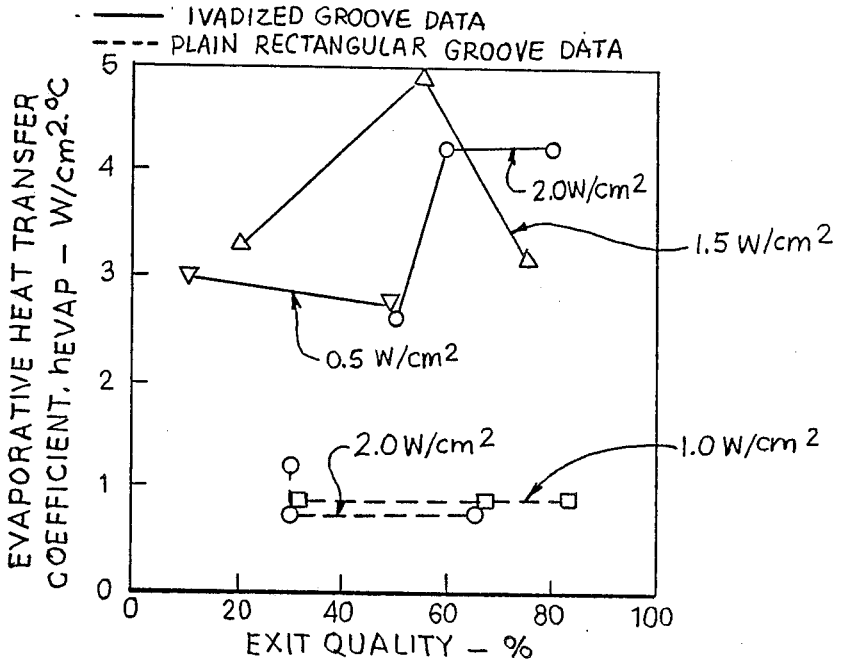
FIG. 14 is a plot showing the evaporative heat transfer coefficient before and after vacuum deposition of aluminum on the grooves.

Tests were performed to compare the performance of the plain rectangular grooves with the vacuum plated grooves. After testing the plain rectangular grooves the unit was disassembled and the grooved aluminum substrate was vacuum plated with aluminum and the unit reassembled and tested for comparison. These tests yielded results only on the heat transfer coefficients of the grooved surface. Capillary performance testing was not possible because the vacuum plated grooves required a different interface wick with a smaller pore size which was not commercially available at the time. However, calculated capillary performance is shown in FIG. 15 and indicates that heat flux capacity of the vacuum plated aluminum grooves is approximately five times that of a plain rectangular grooved aluminum plate. Total heat transfer coefficients, defined as the effective conductance from the outer (heated) surface of the grooved plate to the vapor, were measured and compared in FIG. 13 indicating the vacuum plated grooves, at the same operating conditions, produced a heat transfer coefficient about twice as large as the plain grooves. Purely evaporative heat transfer coefficients, defined as the conductance from the base of the grooves to the vapor, for the two grooves are shown in FIG. 14. The test results show that vacuum plating the grooved evaporative surface significantly increases the heat transfer coefficients. This enhancement allows lower equipment temperature for a given heat flux. Twice the heat transfer coefficient results in half the temperature drop for a given flux. Analytically the vacuum plated aluminum grooved substrate improves the capillary pumping ability approximately five times, thus increasing its maximum heat flux limit.

It appears clear that vacuum plating plain rectangular grooved substrates to control the necking or narrowing of the groove opening and the resultant dendritic surface enhances both the heat transfer coefficient and the capillary pumping capacity of the two phase evaporative heat transfer surface.

What is claimed is:

1. An enhanced capillary assisted evaporative surface comprising:

a conductive substrate;

a plurality of grooves located in said conductive substrate, said grooves having a generally rectangular shape with a generally radiused, necked-down opening;

land between and connecting said grooves; and a dendritic surface on said lands and said generally radiused, necked-down openings of said grooves.

2. The enhanced capillary assisted evaporative surface of claim 1 wherein said dendritic surface is vacuum plated on said lands and said grooves to produce said necked down opening of said grooves.

3. The enhanced capillary assisted evaporative surface of claim 2 wherein said conductive substrate and said dendritic vacuum plated surface are of the same material.

4. The enhanced capillary assisted evaporative surface of claim 3 wherein said conductive substrate and said dendritic vacuum plated surface are both of aluminum alloy material.

5. The enhanced capillary assisted evaporative surface of claim 1 wherein said grooves have a depth of 3 to 6 times the average width of said grooves.

6. The enhanced capillary assisted evaporative surface of claim 5 wherein said generally radiused, necked-down opening of said grooves is between fifteen and sixty percent of the average groove width.

7. The enhanced capillary assisted evaporative surface of claim 1 wherein said grooves have a spacing measured near the bottom of said grooves approximately equal to the average width of said grooves measured near the bottom of said grooves.

8. The enhanced capillary assisted evaporative surface of claim 6 wherein said grooves are sized and spaced so as to have in the vicinity of forty grooves per centimeter.

9. An enhanced capillary assisted evaporative surface comprising:

a conductive substrate having a plurality of closely spaced small grooves with groove openings in at least one surface; and a coating of conductive metal deposited on said grooved surface of said substrate by vacuum deposition so as to produce a generally radiused, necked-down opening in said plurality of spaced small grooves and a dendritic surface on said grooved surface and said necked down groove openings.

10. The enhanced capillary assisted evaporative surface of claim 9 wherein said vacuum deposition is produced by an ion vapor deposition process.

11. The enhanced capillary assisted evaporative surface of claim 9 wherein said coating of conductive metal is an aluminum alloy and said conductive substrate is an aluminum alloy.

* * * * *